US005724018A

United States Patent [19]

Brandl et al.

[11] Patent Number: 5,724,018

[45] Date of Patent: Mar. 3, 1998

[54] DEVICE WITH FOUR-LEGGED COIL

[75] Inventors: Wolfgang Brandl, Amberg; Johann Drexler, Schwandorf; Wilfried Kliemt, Amberg; Bardo Koppmann, Kaltenbrunn; Roland Nagel, Erlangen; Reinhard Zinner, Bodenwöhr, all of Germany

[73] Assignee: Siemens Aktiengesellschaft, München, Germany

[21] Appl. No.: 571,946

[22] PCT Filed: Jun. 22, 1994

[86] PCT No.: PCT/DE94/00713

§ 371 Date: Jan. 5, 1996

§ 102(e) Date: Jan. 5, 1996

[87] PCT Pub. No.: WO95/02255

PCT Pub. Date: Jan. 19, 1995

[30] Foreign Application Priority Data

Jul. 7, 1993 [DE] Germany ..... 43 22 648.5

[51] Int. Cl.[6] ..... H01F 27/04

[52] U.S. Cl. ..... 336/192; 336/90; 336/137

[58] Field of Search ..... 336/192, 90, 98, 336/137

[56] References Cited

U.S. PATENT DOCUMENTS 5,448,216 9/1995 Kuze et al. ..... 336/192

FOREIGN PATENT DOCUMENTS 30 17 561 11/1981 Germany .
0 633 394 12/1949 United Kingdom .

*Primary Examiner*—Adolf Berhane
*Assistant Examiner*—Shawn Riley
*Attorney, Agent, or Firm*—Kenyon & Kenyon

[57] ABSTRACT

A switching device with a four-legged coil and specially designed plug-in locations on the device housing. The first type of plug-in location is connected to the first winding end and will only accept a first type shape-coded connecting terminal. The second type of plug-in location is connected to the second winding end and will only accept a second type shape-coded connecting terminal. This reliably prevents accidental short-circuits.

4 Claims, 3 Drawing Sheets

DEVICE WITH FOUR-LEGGED COIL

BACKGROUND OF THE INVENTION

The invention relates to a device, preferably a switching device, having a four-legged coil.

Such a device is disclosed, for example, in DE-A 3,017,561. This is an electromagnetic switching device, for example a contactor having adjacent connecting planes and having a coil former which has attachments, located in the rear connecting plane, for producing a diagonal connection. The coil former is provided with two projections, which point in the direction of the adjacent connecting planes, for the accommodation of connecting terminals which can be plugged in. Their connecting screws lie in the connecting plane which is adjacent to the rear connecting plane.

SUMMARY OF THE INVENTION

The present invention is designed to optimize the coil connection options in a simple manner, with respect to the number of connecting planes. It is thus possible, if the spatial conditions in the region of the rear connecting plane are inadequate, to use the two additional connection options, lying in the region of the adjacent front plane, to produce a vertical connection for the coils instead of the diagonal connections located here. The coil former of the present invention makes it possible to easily convert the switching apparatus in a way that facilitates insertion and withdrawal operations without having to change to a new coil former. The present invention also has features that ensure that connections are not accidentally interchanged, which could lead to short-circuits.

The present invention is a switching device comprising a four-legged coil. A first end of the winding is connected to one or more first plug-in locations. A second end of the winding is connected to one or more second plug-in locations. The first plug-in locations are shaped to accept a first shape-coded connecting terminal that is connected to a voltage supply. The second plug-in locations are shaped differently than the first plug-in locations to accept a second connecting terminal that is shape-coded differently from the first connecting terminals. The second connecting terminals are also connected to a voltage supply. The plug-in locations and connecting terminals are configured such that a first plug-in location will not accept a second shape-coded connecting terminal, and a second plug-in location will not accept a first shape-coded connecting terminal. This is important because it prevents accidentally connecting the wrong terminal to the wrong plug-in location, possibly leading to a short circuit.

In a preferred embodiment, first plug-in locations and second plug-in locations are provided on a first side of the switching device as well as on a second side. In another preferred embodiment, first plug-in locations and second plug-in locations are provided on the top of the switching device as well as on the bottom. The plug-in locations on the top and bottom of the device can also be provided in addition to plug-in locations on the sides. The switching device can also accept a circuit module that has been configured with appropriate connecting terminals that are properly shape-coded and positioned to fit into the plug-in locations. This configuration ensures that, for example, the circuit module will be connected to the switching device with the proper polarity.

DETAILED DESCRIPTION

Figure 1:
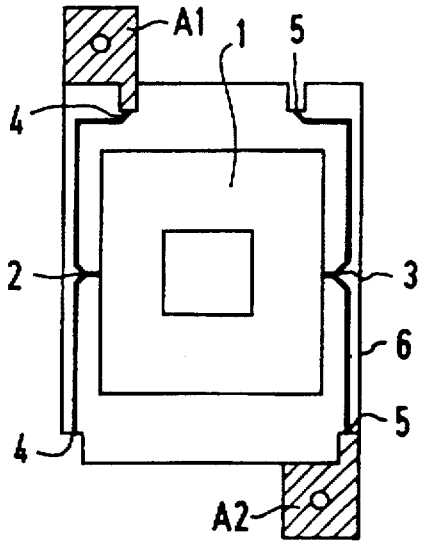
FIG. 1 shows a device having a four-legged coil and plug-in connecting terminals.
Figure 2:
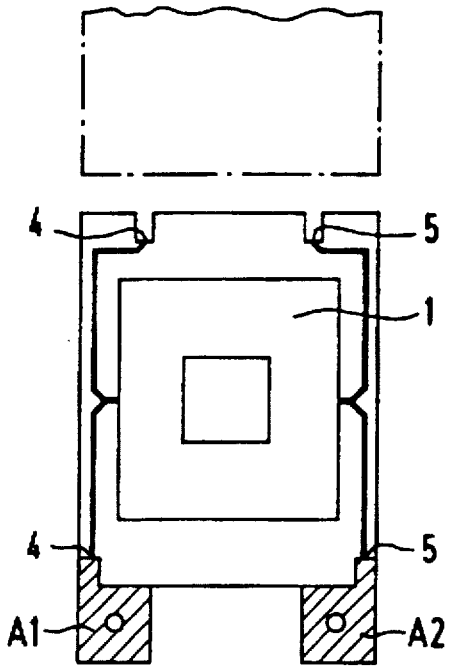
FIGS. 2, 3 show a device having a four-legged coil and connecting terminals plugged in on one side.
Figure 3:
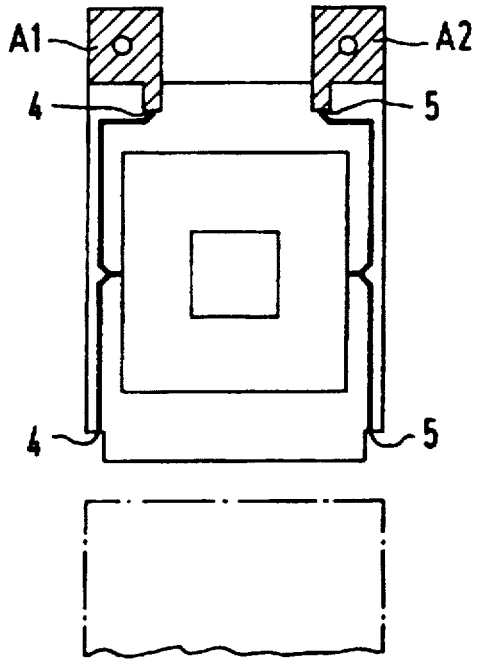

FIG. 1 illustrates by way of indication in a sectional illustration a housing 6 of a device, for example a switching device, having a four-legged coil 1 which has a first winding end 2 and a second winding end 3. There are electrical supply leads from the first winding end 2 to two first plug-in locations 4, and there are electrical supply leads from the second winding end 3 to two second plug-in locations 5, which are each provided on the outer wall of the housing 6. The plug-in locations 4 and 5 are designed differently in order to distinguish between them, each being configured to accept only one type of shape-coded connecting terminals A1, A2. The connecting terminals A1 and A2 are designed with specific shape coding matched to the plug-in locations 4, 5, so that the connection A1 can be plugged only into one of the plug-in locations 4, and the connection A2 can be plugged only into one of the plug-in locations 5. The connections A1 and A2 may both be plugged into to the appropriate plug-in locations on one side of the device as shown in FIGS. 2 and 3, as distinguished from the diagonal configuration of FIG. 1. Plugging both connections into one side leaves the plug-in locations on the other side free to accept, for example, a circuit breaker or overload relay as shown in FIGS. 2 and 3.

Figure 4:
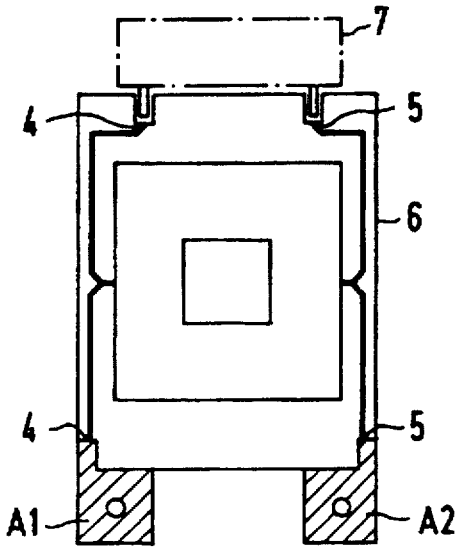
FIG. 4 shows a device having connecting terminals plugged in on one side and having a circuit module which is additionally connected.

As shown in FIG. 4, the present invention advantageously provides the option of using the plug-in locations 4, 5 which are still free on one side of the device for the connection, for example, of a circuit module 7.

Figure 5:
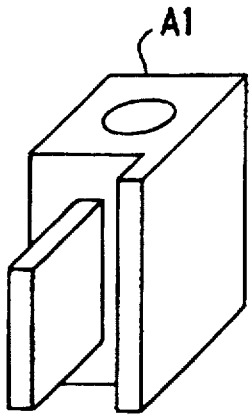
FIGS. 5, 6 show embodiments of shape-coded connecting terminals.
Figure 6:
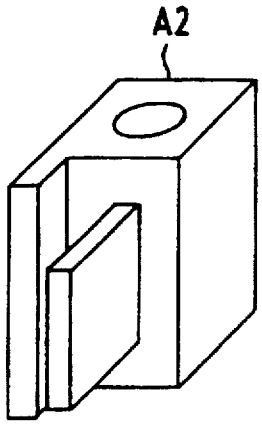

FIGS. 5, 6 show one possible configuration of the shape-coded connections A1 and A2. In this embodiment, the right-parallelpiped connecting terminals A1 and A2 differ only in that, in the connecting terminal shown in FIG. 5, the side to the right of the conductive centerpiece is lengthened by a web 8, while in the connecting terminal shown in FIG. 6, the side to the left of the conductive centerpiece is lengthened by a web 8.

We claim:

1. A switching device comprising:

a first side and a second side;

a four-legged coil with a first winding end and a second winding end;

a first plug-in location and a second plug-in location, each connected to said first winding end;

a third plug-in location and a fourth plug-in location connected to said second winding end;

a first connecting terminal shape coded to match said first plug-in location and said second plug-in location;

a second connecting terminal shape coded to match said third plug-in location and said fourth plug-in location.

2. The device of claim 1 whereby said first plug-in location and said third plug-in location are provided on said first side and said second plug-in location and said fourth plug-in location are provided on said second side.

3. The device of claim 1 further comprising a circuit module that can be connected to said first side of said device at said first plug-in location and said third plug-in location and also to said second side of said device at said second plug-in location and said fourth plug-in location.

4. The device of claim 2 further comprising a circuit module that can be connected to said first side of said device at said first plug-in location and said third plug-in location and also to said second side of said device at said second plug-in location and said fourth plug-in location.

* * * * *